United States Patent [19]

Kasai

[11] Patent Number: 4,859,900

[45] Date of Patent: Aug. 22, 1989

[54] IGNITION PLUG FOR IMPROVING FUEL ECONOMY OF AN INTERNAL COMBUSTION ENGINE AND DECREASING THE AMOUNT OF TOXICANTS EXPELLED TO THE ENVIRONMENT

[76] Inventor: Kotoo Kasai, 9, Yodogawa-cho 1-chome, Fujinomiya-shi, Shizuoka, Japan

[21] Appl. No.: 191,051

[22] Filed: May 6, 1988

[51] Int. Cl.[4] ..... H01T 13/02

[52] U.S. Cl. ..... 313/120; 313/143; 123/169 V

[58] Field of Search ..... 313/120, 119, 132, 143, 313/144, 145; 123/169 R, 169 EL, 169 PA, 169 V

[56] References Cited

U.S. PATENT DOCUMENTS

| | | | |
|---|---|---|---|
| 3,079,453 | 2/1963 | Clark | 313/120 X |
| 4,325,332 | 4/1982 | Hukill | 313/120 X |
| 4,513,220 | 4/1985 | Togashi | 313/120 |
| 4,736,718 | 4/1988 | Linder | 313/120 |

FOREIGN PATENT DOCUMENTS

| | | |
|---|---|---|
| 53-70233 | 6/1976 | Japan . |
| 55-84868 | 6/1980 | Japan . |

*Primary Examiner*—Kenneth Wieder

*Attorney, Agent, or Firm*—Cushman, Darby & Cushman

[57] ABSTRACT

An ignition plug for use in an internal combustion engine comprises a plug main body, a central electrode embedded to the inside thereof and having a tubular structure through which atmospheric air is introduced to the inside of cylinder for the complete combustion of unburnt gases and a check valve mechanism disposed within the air introduction channel for preventing the back flow of the gas from the cylinder to the channel, wherein the atmospheric air is introduced by way of a non-linear path to the central electrode so that electric discharge from the central electrode to the outside can be prevented, and a check valve mechanism comprises a gravity actuation type main check valve and a spring-biased type auxiliary check valve so that the backward flow of the cylinder gas can surely be prevented.

4 Claims, 2 Drawing Sheets

IGNITION PLUG FOR IMPROVING FUEL ECONOMY OF AN INTERNAL COMBUSTION ENGINE AND DECREASING THE AMOUNT OF TOXICANTS EXPELLED TO THE ENVIRONMENT

BACKGROUND OF THE INVENTION

1. Field of the Invention

The present invention concerns an ignition plug for use in an internal combustion engine and, particularly, it relates to an ignition plug to be attached upon use to the upper chamber of a cylinder in a gasoline engine, etc.

2. Description of the Prior Art

It has been known that unburnt gases remaining in the upper cylinder chamber of an internal combustion engine after the explosion stroke impair the fuel economy in the engine operation, as well as form toxic CO, NOx, hydrocarbons, etc. at high temperature in the cylinder chamber, which are exhausted externally to cause public pollutions.

In view of the above, various means have been developed and put to practical use for additionally supplying fresh atmospheric air to the inside of the cylinder chamber for the complete combustion of remaining unburnt gases. However, most of such technical means in the prior art inevitably require modification to the structure of the engine cylinder itself and yet the performance is not always quite satisfactory.

The present inventor has found that the engine torque obtained for the piston in the cylinder chamber during the explosion stroke is not caused by a uniformly expanding torque but by an impactive torque exerted irregularly on the cylinder wall, as well as that localized negative pressure (as compared with the atmospheric pressure) sometime occurs in the upper portion of the cylinder chamber at the end of the explosion stroke. Such uneven negative pressure or partial vacuum in the cylinder hinders uniform and smooth propagation of combustion flames to prevent the complete combustion of the gas mixture in the cylinder and this increased the issue of unburnt gases, which are wastefully exhausted and cause public pollutions. In addition, the negative pressure caused in the cylinder decreases the transmission efficiency of the torque to the cylinder upon explosion and, further, generates unpleasant vibrations during operation of the engine.

The present invention has already proposed a technique of additionally intaking fresh atmospheric air through the hole formed through an ignition plug by utilizing the negative pressure generated in the cylinder upon explosion stroke thereby forming a combustible gas mixture of additional air and unburnt gases and burning them again (Japanese Patent Publication No. Sho 59-23635, etc.).

In the ignition plug of our proposed structure, fresh atmospheric air is introduced by way of the air introduction channel in the ignition plug and supplied into the cylinder chamber upon sudden decrease of the pressure in the chamber at the final stage of the explosion stroke, to attain complete combustion for the unburnt gases. Further, introduction of the fresh air at low temperature can suppress NOx, CO, hydrocarbons, etc., which would otherwise result at high temperature in the cylinder, thus public pollution caused by exhaust gases can remarkably be reduced.

Further, since the unburnt gases are burnt again by the introduction of the fresh secondary air, engine torque can be increased to remarkably reduce the fuel cost. Further, since the negative pressure in the cylinder is eliminated, undesirable mechanical vibrations experienced so far in the conventional engine can be removed.

Since, the atmospheric air can be introduced into the cylinder by merely replacing existent ignition plugs with that of the present invention, it can be applied easily to any kind of engine with no difficulty.

However, ignition plugs of this type still have room for structural improvements.

Since a high voltage of about 10,000 volts or higher is applied for electric spark discharge to the ignition plug, insulators or shieldings are generally provided to the electric supply portion of the ignition plug such that neither external short-circuit nor aerial discharge results.

In the proposed plug, however, complete coverage for the plug is difficult since the central electrode used for introducing the air is inevitably exposed to the outside through the air intake port perforated in the cylindrical wall of the ignition plug. Then, high voltage applied to the central electrode may cause short-circuit failure between the electrode and other metal parts, etc. or may cause radio frequency wave troubles to electronic control devices disposed in an automobile.

There is also an additional problem that the flow rate of external air taken in through the air intake port has to be controlled depending on the capacity of engine cylinders, kind of fuels used, etc. for the complete combustion of the unburnt gases. Accordingly, since it is required to adjust the opening area of the air intake port upon mounting the ignition plug to each of the engine cylinders, it is difficult to mass-produce general-purpose plugs.

SUMMARY OF THE INVENTION

The object of the present invention is to provide an ignition plug of the above-mentioned type capable of preventing short-circuit or aerial discharge from the central electrode to the outside.

Another object of the present invention is to provide an ignition plug being capable of adapting to cylinders of various capacities, fuels employing, etc.

The foregoing object of the present invention can be attained in an ignition plug attached upon use to the cylinder of an internal combustion engine having :

a plug main body made of insulating ceramic material, a central electrode embedded axially through the inside of the plug main body and having a tubular structure that defines therein an air introduction channel for introducing atmospheric air from the outside of the plug into the cylinder and a valve mechanism capable of closing and opening the air introduction channel depending on the difference between the gas pressure in the cylinder and the atmospheric pressure, wherein the air introduction channel of the central electrode is in communication with an air intake port perforated through the wall of the plug main body by way of a nonlinear path for attenuating the electrical discharge from the central electrode to the outside of the plug, and the valve mechanism includes :

a main check valve of gravity actuation type adapted to open the air introducing channel gravitationally only when the atmospheric pressure overcomes the gas pressure in the cylinder and an auxiliary check valve of resiliently biased type adapted to open the air introduction channel only when the atmospheric pressure overcomes the biasing resiliency.

According to the present invention, since the ignition plug has, embedded therein, a central electrode of a tubular structure that defines therein an air introduction channel, atmospheric air can be introduced through the air intake port perforated through the circumferential wall of the plug main body and by way of the air introduction channel of the central electrode and then to the inside of the cylinder chamber, thereby enabling complete combustion of unburnt gases, reducing the fuel cost, decreasing the mechanical noises and preventing the formation of NOx and CO, hydrocarbons, etc. In addition, backward flow of the gas from the cylinder to the atmosphere through the air introduction chamber can be prevented by the check valve mechanism disposed in the air introduction channel.

Particularly, since the air introduction channel formed in communication with the air intake port of the plug main body by way of a non-linear path, the creeping distance from the central electrode to the outside of the plug main body is increased to thereby eliminate the danger that high voltage causes short-circuit, as well as the aerial discharge from the central electrode can significantly be attenuated because the electromagnetic waves at high frequency undergo great hindrance upon propagation through the non-linear path.

In addition, in a preferred embodiment wherein the check valve mechanism comprises a gravity actuation type main valve and a biased auxiliary check valve, the backflow of the cylinder gas to the air intake port can surely be prevented by the double-check valve mechanism. In this case, it is desirable that the valve body of the main valve is made of highly heat resistant material such as inconel alloy since the main valve is directly exposed to the high temperature of the cylinder chamber. Since the valve is of the gravity actuation type having no complicated mechanism, it undergoes no substantial failure, although put under high speed operation at high temperature.

While on the other hand, the biased auxiliary valve disposed upstream to the main valve can surely compensate the checking operation of the main valve even when the latter should lose its checking function and vibrate in a transient state in the air introduction channel in a case where the rotation of the engine becomes too high and the valve movement can no more exactly follow such high speed operation. Even in such a case, the auxiliary valve can surely keep the air introduction channel closed by the positive resiliency such as of a spring. The auxiliary valve required no particular considerations for the heat resistance since the auxiliary valve is free from the direct exposure to the high temperature of the cylinder since the main valve is put between them.

In a preferred embodiment, the non-linear path is formed by a roundabout groove engraved to the circumferential surface of the plug main body and a cylindrical ring airtightly fitted thereover. Further, the ring may comprise a dual structure having a fixed inner ring and a rotatable outer ring each having an air intake port perforated through the respective ring walls. In this case, the flow rate of the intaken air can easily be controlled by aligning the relative position of these ports by the relative rotation of the rings.

Since this structure enables adjustment of the flow rate of the atmospheric air and enables optimum supply of the air, the plug can be used for wide variety of automobiles by the mere rotational adjustment of the two rings.

In the present invention, the introduction of fresh atmospheric air to the inside of the cylinder for the complete combustion of unburnt gases can be attained with no particular modification or reconstruction of the engine structure as in the prior art but it can be done by merely replacing the existent ignition plug with that of the present invention.

BRIEF DESCRIPTION OF THE ACCOMPANYING DRAWINGS

These and other objects, as well as advantageous features of the present invention will become more apparent by reading the following descriptions for preferred embodiments according to the present invention while referring to the accompanying drawings, wherein FIG. 1 is a cross sectional explanatory view for illustrating the ignition plug somewhat in an enlarged scale according to the present invention;

FIGS. 2 and 3 are, respective enlarged cross sectional explanatory views for a portion of the ignition plug as viewed along two opposite directions in perpendicular to the drawing sheet, and FIG. 4 is an enlarged cross sectional view for a portion of an ignition plug as another embodiment according to the present invention.

DETAILED DESCRIPTION OF PREFERRED EMBODIMENTS

Figure 1:
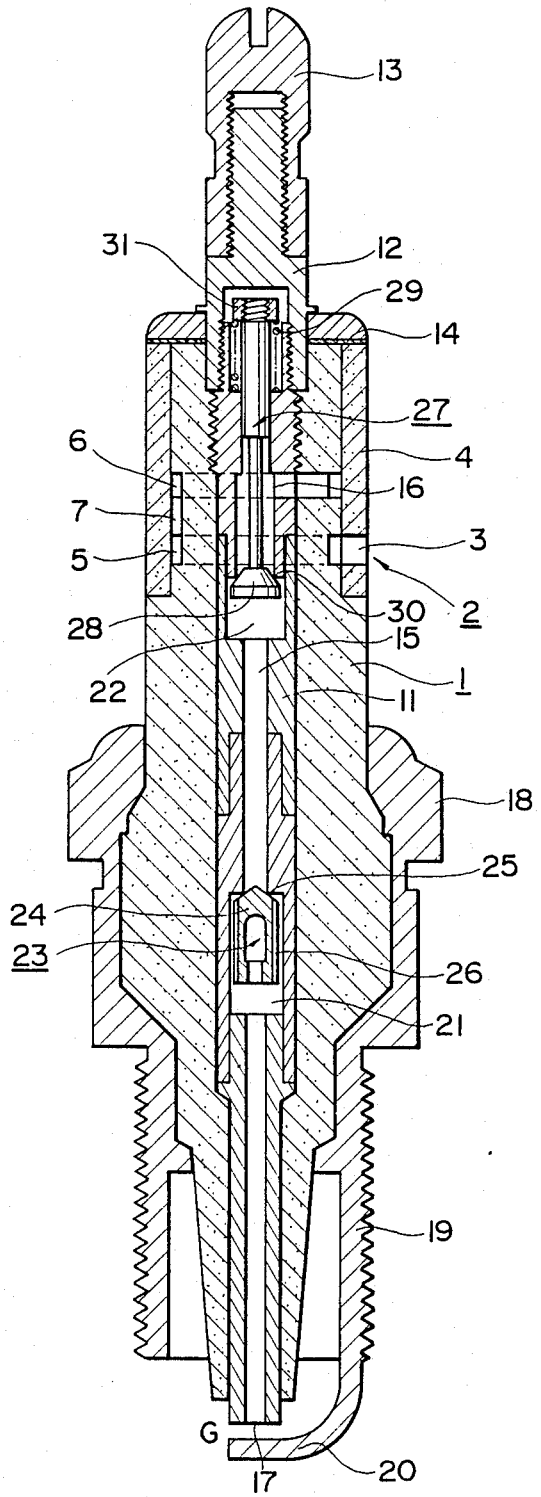

FIG. 1 illustrates an enlarged vertical cross sectional view of an ignition plug for use in a gasoline engine according to the present invention. In FIG. 1, an ignition plug comprises a substantially cylindrical plug main body 1 made of electrically insulating ceramic material. An external air intake port 2 in the form of aperture 3 is perforated to the wall of the main body 1.

A tubular central electrode 11 made of electroconductive metal is extended axially through the inside of the plug main body 1, with the top end thereof being connected by way of a holder 12, etc. to a receiving terminal 12 for high spark discharge voltage. The lower end of the metal electrode 11 is extended and exposed at exit 17 thereof to the inside of a cylinder chamber (not illustrated). A metal fixture 18 is mounted around the lower portion of the plug main body 1 and a threaded portion 19 integrally extended below is screw coupled into the wall of the cylinder chamber. A counter electrode 20 extended from the metal fixture 18 (19) is opposed with a discharge gap G to the lower end 17 of the central electrode 11 within the cylinder chamber. The central electrode 11 has, axially formed therein, an air introduction channel 15, the upper end of which is perforated with an air inlet 16 in communication with the air intake port 2 (3) of the plug main body 1 and the lower end in which is opened as the air exit 17.

Two valve chambers 21 and 22 are formed in series to each other within the enlarged diameter portion of the air introduction channel 15. In the valve chambers 21 and 22, a main check valve 23 and an auxiliary check valve 27, acting as the check valve mechanism for allowing only the atmospheric air to pass from the side of the air inlet 16 to the air exit 17, are housed.

The main check valve 23 is adapted to abut against the valve seat 25 upwardly against its own weight to close the air flow introduction channel 15 by the pressure of gas exerted from the cylinder chamber (not illustrated). The main check valve 23 is also adapted to move downwardly from the valve seat 25 by its own weight to open the air introduction channel 15 if the pressure of gas inside the cylinder is suddenly reduced as compared with the pressure of atmospheric air introduced from the air intake port 2 at the final stage of the engine explosion stroke.

The main valve 23 has vertical gas conduits 26 formed at the outer circumferential surface thereof along the direction of the channel 15 so that atmospheric air can flow through the conduits 26 to the air exit 17 when the valve seat 25 is opened upon falling of the valve 23.

Thus, the main valve 23 is adapted to close and open the air introduction channel 15 repeatedly during operation of the gasoline engine. However, if the engine rotation goes extremely higher, there may occur such a case where the ON/OFF movement of the valve 23 can no more exactly follow the high speed operation of the engine and the valve body merely vibrates being floated in the valve chamber 21 in a transient manner. In this case, the combustion gas in the cylinder may possibly flow backwardly through the air introduction channel 15 out of the air intake port 3 undesirably.

The auxiliary valve 27 is disposed upstream of the main valve 23, that is, on the side of the air inlet 16 of the air introduction channel 15, so as to surely prevent such an undesirable state.

The auxiliary valve 27 is housed within the valve chamber 22 and the valve head 28 is always upwardly urged to close the valve seat 30 by the resiliency of a spring 29 attached to the valve shaft. The spring force is adjusted by turning a nut 31 disposed to the valve such that the spring 29 can abut the valve 28 upwardly to the valve seat 30 against the own weight of the valve 27 and the atmospheric pressure exerted downwardly.

Specifically, the valve 27 is so adapted that it always keeps the air introduction channel 15 closed by its spring force and opens the air introduction channel 15 only when the difference between the atmospheric pressure and the pressure at the downward face of the valve head 28 overcomes the force of the spring 29.

In FIG. 1, the upper portion of the plug main body 1 comprises a central cylindrical body having a diameter somewhat smaller than that of other lower portions and a ring member 4 coaxially fitted rotatably to the outer circumference of the diameter-reduced portion in an airtight manner. An external air intake aperture 3 is perforated through the wall of the ring 4 which is in communication with the air inlet 16 of the central electrode 11 by way of non-linear roundabout path as described just below.

Figure 2:
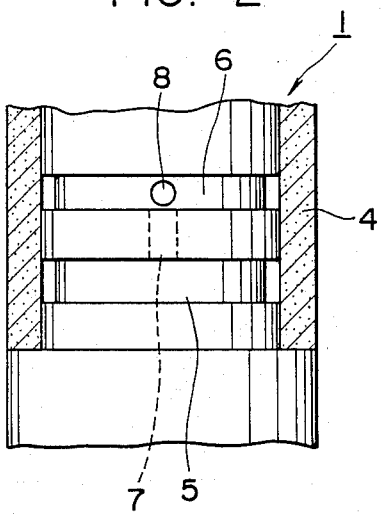
Figure 3:
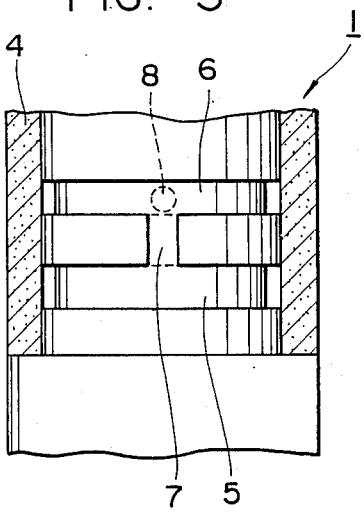

As shown more specifically in FIG. 2 and FIG. 3, circumferential grooves 5 and 6 vertically spaced apart from each other are formed turning around the circumference of the plug main body 1. The lower circumference groove 5 is formed at a height corresponding to that of the aperture 3 formed in the ring 4, while the upper circumferential groove 6 is formed at a height corresponding to the air inlet 16 of the central electrode 11 and an aperture 8 is perforated through the bottom wall of the groove 6 in communication with the air inlet 16.

Further, a connection groove 7 is formed vertically so as to communicate the upper and the lower circumferential grooves 5 and 6 with each other at the position diametrically opposing to the aperture 3 of the ring 4.

Thus, the air intake port 2 of the main body 1, that is, the aperture 3 of the ring 4, is in communication with the air inlet 16 of the tubular central electrode 11 by way of a non-linear roundabout path including the grooves 5, 6 and 7 formed between the outer circumferential wall surface of the plug main body 1 and the inner circumferential wall of the ring 4.

More specifically, the path turns and flexes along the route including: air inlet 16 (90° flexing)→circumferential groove 6 (180° circumferential turning)→vertical groove 7 (90°, twice radial flexing)→circumferential groove 5 (180° circumferential turning)→intake port 2 (aperture 3). The above-mentioned groove functions as a non-linear roundabout path for greatly attenuating the electromagnetic waves, etc. radiated from the central electrode 11 through the air intake port 2 to the outside of the plug.

Figure 4:
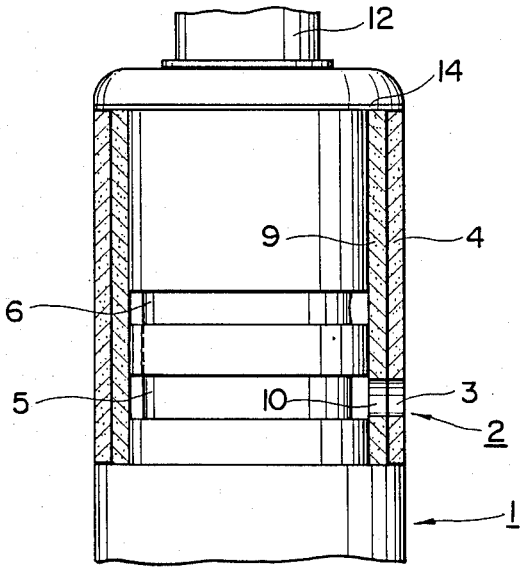

FIG. 4 shows another embodiment of the plug main body according to the present invention. An air intake adjust ring 9 is fixedly disposed between the outer circumferential wall of the plug main body 1 and the inner circumferential surface of the ring 4 which is made rotatable. An air intake adjustment hole 10 is perforated through the ring 9 at a height corresponding to the aperture 3 of the outer ring 4. The ring 4 is made rotatable between a position where aperture 3 and the adjustment hole 10 are completely overlapped with each other for maximizing the air-intake and a position where the apertures 3 and 10 are apart from each other. The rotational ring 4 is secured by means of a spacer to the plug main body 1 after the optional position has been set.

The operation of the ignition plug shown in the drawings according to the present invention will be described briefly.

When the pressure of the gas in the engine cylinder is at a positive level as compared with the atmospheric pressure, for example, during compression stroke of the engine, the main valve 23 contained in the valve chamber 21 is raised against its own weight to the valve seat 25 formed above the valve chamber 21 due to the pressure difference between the upward pressure of the cylinder gas and the downward atmospheric pressure, to thereby close the air introduction channel 15 for the atmospheric air (the state shown in FIG. 1). Then, at the final stage of the explosion stroke when the gas pressure within the cylinder is rapidly decreased to a predetermined pressure, the main valve 23 falls gravitationally to release the valve seat 25 and allow the atmospheric air from the introduction channel 15 to pass by way of the gas conduits 26.

Accordingly, the atmospheric air is sucked from the air intake port 3 and introduced by way of the air introduction channel 15 to the inside of the cylinder from the air exit 17, thereby attaining the complete combustion of unburnt gases remaining in the cylinder. This can suppress the generation of toxic ingredients such as CO hydrocarbons, etc. Further, since introduction of the fresh atmospheric air somewhat cools the inside of the cylinder, generation of NOx can be reduced. Furthermore, since additional torque can be obtained by the secondary combustion of unburnt gases with the additional air, the fuel cost can be economized. Further, since the negative pressure in the cylinder is eliminated by the introduction of the external air, generation of undesirable vibrations can be reduced.

Then, when the pressure of the gas in the cylinder increases along with the operation of the engine, the main valve 23 is urged upwardly to close the valve seat 25 again.

During extremely high speed operation of the engine, the checking operation of the main valve 23 may sometimes become unreliable as it may temporarily vibrate while being floated in the valve chamber 21, by which the combustion gas at high pressure in the cylinder may jet out into the upstream channel 15. However, since the valve head 28 of the auxiliary check valve 27 is always brought into close contact with the valve seat 30 by the resiliency of the spring 29, backward flow of the gas further to the air intake port 2 can surely be prevented.

During operation of the ignition plug as described above, a high voltage applied to the receiving terminal 13 for spark discharge may sometimes bring about short-circuit failures between the central electrode 11 and the external mechanisms due to creeping discharge, or radiowave propagation troubles to electronic control devices equipped in the automobile due to aerial discharge, etc. However, in this embodiment, the high voltage is discharged from the central electrode 11 to the outside of the plug body 1 by way of the non-linear roundabout path including the circumferential grooves 5, 6 and the connection groove 7, etc. Accordingly, electromagnetic waves, for example, radiated from the central electrode 11 and propagated to the air intake port 2 are greatly attenuated when they pass through the a roundabout path thereby completely preventing the short-circuit failure or radioactive wave troubles.

In the embodiment shown in FIG. 4, the flow rate of atmospheric air introduced through the intake port 2 can properly be adjusted by rotating the ring 4 thereby controlling the overlap between the aperture 3 and the adjustment hole 10 perforated through the rings 4 and 9 respectively. Once air flow rate has been adjusted properly, the rotational ring 4 is secured at that position.

TEST EXAMPLE 1

The ignition plug according to the present invention is mounted to an actual automobile which was caused to run for testing the fuel consumption and examination of exhaust gases. The results are shown below in comparison with a conventional ignition plug.

The test was conducted by The Foundation of Japan Vehicle Inspection Association in Saitama, Japan.

In the test, the ignition plug according to the present invention showed about 1% of air intake from the ignition plug based on the entire air intake amount of the gasoline engine assuming the intake efficiency as 50% and providing that a 4-cylinder type gasoline engine of 1368 cc exhaust capacity was caused to run under the idling state of 650 rpm.

| | Test condition | | | | |
|---|---|---|---|---|---|
| Type of vehicle | Running distance up to the test (km) | Running distance in the test (km) | Gasoline used in the test (liter) | Ignition plug | Running distance per 1 l gasoline (km) |
| Nisssan L-16 | 16530 | 530 | 58 | Reference | about 9.3 |
| Nissan L-16 | 16530 | 515 | 43 | present invention | about 12 |

As apparent from the test results shown in Table 1, the fuel consumption can be remarkably improved when the ignition plug according to the present invention was employed. Neither short-circuit failure nor radiowave troubles attributable to the plug portion was observed.

TEST EXAMPLE 2

Using the ignition plug according to the present invention, release of the toxic ingredients in the engine exhaust were detected in comparison with that of the conventional ignition plug. During this test, a test car (Toyota KE-11, four-cylinder, fueled with non-lead gasoline) was caused to run at a constant speed of 40 km/H. The test conditions were as follows. Temperature: 24.5°-25.5° C., Relative humidity : 25.9-27.1%, Atmospheric pressure: 766.0 mmHg, Air absorption pressure: −465−−470 mmHg (40 kg/H), NOx moisture compensation coefficient: 0.845.

| | CO | HC | NOx | $CO_2$ |
|---|---|---|---|---|
| Present invention | 3.33 | 0.78 | 0.33 | 90.4 |
| Reference | 3.46 | 0.85 | 0.33 | 90.2 |

As apparent from the foregoing result, the toxic ingredients in exhaust gases such as CO, HC were reduced to below allowable ranges when using the ignition plug according to the present invention, as compared with the Reference plug. In the above result of the experiment, although the effect is not clear only for NOx, when the outer ring of the plug is rotationally adjusted to control the flow rate of the intaken atmospheric air, the content of the NOx could be compensated further.

What is claimed is:

1. An ignition plug adapted to be attached to a cylinder of an internal combustion engine comprising:

a plug main body made of insulating ceramic material and having a continuous groove formed along the outer circumferential surface of an upper portion of said plug main body;

a central electrode embedded axially through the inside of said plug main body and having a tubular structure that defines therein an air introduction channel for introducing atmospheric air from the outside of the plug into the cylinder of the engine;

a ring member made of insulating material coaxially disposed air tightly over the grooved surface of said plug main body to define therebetween a non-linear air path, means defining an air intake port formed radially through a wall of said ring member in communication with an end of said groove, and means defining an air inlet formed radially through a wall of said plug main body and a wall of said central electrode at a position different from that for said air intake port in view of circumferential position and/or axial position; and a valve means for closing and opening said air introduction channel depending on the difference between gas pressure in said cylinder and atmospheric pressure, said valve means including a main check valve of gravity actuation type adapted to open said air introducing channel gravitationally only when the atmospheric pressure overcomes the gas pressure in said cylinder and an auxiliary check valve of resiliently biased type adapted to open said air introduction channel only when the atmospheric pressure overcomes biasing resiliency.

2. An ignition plug as defined in claim 1 wherein said ring member is rotatably fitted to the outer circumferential wall surface such that said air intake port is aligned with said groove circumferentially formed to said surface.

3. An ignition plug as defined in claim 1 wherein the ring member comprises a fixed inner ring and an outer ring rotatably fitted thereover, each of the rings being formed with an air intake port respectively which can overlap or apart with each other for controlling the flow rate of air intaken to the plug.

4. An ignition plug as defined in claim 1, wherein the circumferential groove comprises at least two vertically spaced apart circumferential grooves each extended substantially over the entire circumferential wall and a groove for connecting said circumferential grooves with each other.

* * * * *